US011459749B2

(12) United States Patent
Harder et al.

(10) Patent No.: US 11,459,749 B2
(45) Date of Patent: Oct. 4, 2022

(54) FIRE BLANKET FOR EXPANSION JOINTS AND METHOD FOR RETARDING FIRE PAST EXPANSION JOINTS

(71) Applicant: Balco, Inc., Wichita, KS (US)

(72) Inventors: John Michael Harder, Wichita, KS (US); Sai B. Pottavathri, Wichita, KS (US)

(73) Assignee: Balco, Inc., Wichita, KS (US)

( * ) Notice: Subject to any disclaimer, the term of this patent is extended or adjusted under 35 U.S.C. 154(b) by 233 days.

(21) Appl. No.: 16/849,624

(22) Filed: Apr. 15, 2020

(65) Prior Publication Data

US 2020/0340241 A1 Oct. 29, 2020

Related U.S. Application Data

(60) Provisional application No. 62/838,412, filed on Apr. 25, 2019.

(51) Int. Cl.
*E04B 1/94* (2006.01)

(52) U.S. Cl.
CPC ..... *E04B 1/948* (2013.01); *E04B 1/941* (2013.01); *E04B 1/946* (2013.01)

(58) Field of Classification Search
CPC . E04B 1/941; E04B 1/62; E04B 1/946; E04B 1/948
See application file for complete search history.

(56) References Cited

U.S. PATENT DOCUMENTS

| | | | | | |
|---|---|---|---|---|---|
| 4,811,529 | A * | 3/1989 | Harris | E04B 1/6815 | 428/920 |
| 4,942,710 | A * | 7/1990 | Rumsey | E04B 1/6815 | 52/468 |
| 5,461,838 | A * | 10/1995 | Heller | E04B 1/948 | 52/573.1 |
| 5,765,332 | A * | 6/1998 | Landin | E04B 1/948 | 52/235 |
| 6,112,488 | A * | 9/2000 | Olson | E04B 1/948 | 52/573.1 |
| 8,082,715 | B2 * | 12/2011 | Shaw | E04B 1/948 | 52/396.04 |
| 8,935,897 | B2 * | 1/2015 | Shaw | E04B 1/948 | 52/396.04 |
| 9,428,904 | B2 * | 8/2016 | Barr | E04B 1/74 | |
| 2005/0102941 | A1 * | 5/2005 | Barr | E04B 1/6804 | 52/459 |
| 2009/0183456 | A1 * | 7/2009 | Shaw | E04B 1/948 | 52/749.1 |

* cited by examiner

*Primary Examiner* — Paola Agudelo
(74) *Attorney, Agent, or Firm* — Marc L. Delflache; Jones Delflache LLP

(57) ABSTRACT

An improved fire blanket for use in expansion joints of buildings to retard the movement of fire and smoke. The invention permits movement of the joint without damaging or otherwise compromising the fire-retardant properties of the barrier. This movement may occur when the width of the joint changes due to expansion or contraction of the joint or when one side of the joint moves relative to the other along the length, or longitudinal axis, of the joint. The expansion and contraction introduce compressive and tensile loads and the relative movement along the length of the joint introduces shear loads. The invention prevents such compressive/tensile and shear loads from being introduced into the assembly and impacting its fire-retardant capabilities.

11 Claims, 3 Drawing Sheets

FIRE BLANKET FOR EXPANSION JOINTS AND METHOD FOR RETARDING FIRE PAST EXPANSION JOINTS

This application is based on priority U.S. provisional application 62/838,412, filed Apr. 25, 2019 and entitled Fireblanket For Expansion Joints, which application is hereby incorporated by reference in its entirety and made a part of this Application.

FIELD OF THE DISCLOSURE

The present disclosure relates generally to fire resistant joint systems used in expansion joint spaces and gaps in structures and method of same.

BACKGROUND OF THE DISCLOSURE

Buildings experience stresses from various sources, such as winds, temperature changes, foundation and structural issues, seismic events, storms and so forth. This requires that buildings move to relieve such pressures, and building codes require that most structures be constructed with spaces between adjacent building units (e.g. floors, walls, etc). These spaces or gaps within a building allow it to move so that two or more adjacent structures within the building are not damaged. Such spaces or gaps are commonly referred to as "expansion joints". However, these expansion joints are also potential avenues for fire and smoke to migrate from one area of the building to another. Accordingly, it is necessary that expansion joints have some type of fire barrier to assure that if a fire occurs, fire and smoke do not migrate through the expansion joint into another portion of the building.

Additionally, fire barriers must be tested and certified. One test focuses on the ability of the barrier to withstand repetitive movement (i.e. "cycling") within the gap due to movement of one side of the gap relative to the other side of the gap, but still maintain the structural integrity of the barrier under compressive and tensile load (See, ASTM Standard E1399). This cycling occurs when a building moves under repetitive stresses which can result from common occurrences such as temperature changes, and seismic and wind loads. Another test requires that after passing the "cycling" test it must also pass fire resistance tests (See, UL 2079 and ASTM Standard E1966-15(2019)).

Because of the testing required for fire barriers in expansion joints, it is difficult, if not impossible for building contractors to fabricate on site and install such barriers. Accordingly, contractors typically use pre-assembled fire barriers. Thus, fire barrier manufacturers have developed pre-assembled fire barriers that are attached to the opposite sides of an expansion joint or gap.

However, there are problems with the existing fire barriers.

First, often the expansion joint or gap is long, and this presents problem. In order to cover a long, straight gap, several barriers, or sections of barriers, must be utilized since any single pre-assembled barrier is not long enough. The problem is that at the ends of the respective fire barrier sections there could be potential pathways for fire since the two sections are not sufficiently connected. These pathways may allow hot air, smoke, toxic gases, and fire to travel throughout the expansion-joints of a building. Currently, manufacturers are splicing designs that can be difficult to implement in the field and/or are subject to mistakes when installed. (U.S. Pat. No. 8,935,897). This is because these splicing connections are sometimes installed by non-specialists and if not done correctly, they may not be sufficiently connected to minimize the chance of a pathway for a fire. Additionally, the regions where different sections are connected may not be able to withstand the stresses caused by tensile and compressive cyclical loads or shear loads when one side of the gap move longitudinally relative to the other side of the gap. Moreover, the conventional on-site splicing can significantly increase labor costs and result in safety issues such as potential cuts from the remaining sharp edges of the barrier penetrating cutting through metallic foils within the assembly which blocks the fire.

Second, the installation is often difficult due to space limitations. The installer must attach the barrier by hanging it from both sides of the gap. Thus, a system must be included to hang the barrier. Currently, the practice is simply to include a single flange (U.S. Pat. No. 6,131,352). However, not all gaps provide sides that may be used to hang such a barrier in a convenient manner.

Third, in a seismic event, for example, each side of the expansion joint or gap may, either longitudinally or transversely or both, move relative to one. In other words, the gap moves axially along its length, relative to the other side of the gap introducing a shear load on the barrier. In some jurisdictions, in addition to the "cycling" requirement discussed above, the barrier is also required to withstand minimal shear loads. For a fire barrier to withstand "shear" forces it is preferable to include a system that will permit one side of the barrier to slide relative to the side of the gap so that both sides of the barrier remain stationary and shear load is avoided on the barrier. This may be done with a shear track that allows the fire barrier to remain static in an axial or longitudinal direction as each side of the gap moves axially or longitudinally relative to one another. However, existing sliding or shear tracks are difficult to install since one side of the sliding track must be installed within or inside of the gap between the two structures within the building. This is a problem because when the gap is not large enough it can be difficult, if not impossible, to attach the sliding track to one side of the gap. The gap is just too narrow, and installation is difficult, if not impossible. The installer simply cannot get a drill down inside the gap to attach one side of the sliding track to the inward facing edge of one side of the gap. Additionally, there are often steel members present on the sides of the joint which are very difficult to fasten through.

Accordingly, a pre-assembled fire barrier is desirable that can seal expansion joints between adjacent structures to inhibit the spread of fire and smoke that satisfies all three of the existing limitations of the prior art as discussed above—improved end connection of adjacent barriers, improved hanging techniques to hang the barrier to each structural member of each side of the gap, and permitted improved installation of the sliding track within a narrow gap.

SUMMARY OF THE DISCLOSURE

Accordingly, the present disclosure includes features and advantages which are believed to enable it to advance fire blanket barriers within expansion joints of a building. Characteristics and advantages of the present disclosure described above, and additional features and benefits will be readily apparent to those skilled in the art upon consideration of the following detailed description of various embodiments and referring to the accompanying drawings.

Accordingly, the present invention is an improved fire and smoke barrier to be installed within an expansion joint between a first structural building member and a second structural building member having a first layer of a fire-blocking material. The present invention also includes a second layer of a fire-blocking material sandwiched adjacent the first layer of fire-blocking material. The ends of the first and second fire-blocking materials are offset so that a first expansion joint fire barrier assembly can be spliced onto an adjacent second expansion joint assembly also with offset ends. The present invention also includes a first flange for attaching the first expansion joint fire barrier assembly to the first structural building member and a second flange for attaching the first expansion joint fire barrier assembly to the second structural building member. Additionally, the present invention includes a male or female portion of a shear track coupled to the second flange and an infill fire-retardant blanket installed below the shear track. The infill blanket includes an attachment strap that is between the second flange and the second structural building member and serves to attached one side of the shear track and the second flange to the second structural building member independent of the width of the gap.

In at least one embodiment the second flange is attached to a top face of the second structural building unit.

In at least one embodiment the first and second layers of fire-blocking material are ceramic blankets that may be sandwiched between thin metallic foils.

The invention also includes an improved installation technique of a fire blanket barrier. The method provides for a simplified process by permitting the installer to place a fire blanket barrier without having to work within narrow confines of the width of the joint or gap. The invention permits the placement of the barrier from above the joint or gap. This includes placement of a slider providing for movement of one side of the joint or gap relative the other side of the joint or gap. The process permits the barrier to be hung within the gap using the top surfaces of the adjacent structural building members and not the side surfaces of adjacent structural building members.

BRIEF DESCRIPTION OF THE DRAWINGS

The following figures are part of the present specification, included to demonstrate certain aspects of various embodiments of this disclosure and referenced in the detailed description herein. In order that the present disclosure may be more fully comprehended, the disclosure will be described, by way of example, with reference to the accompanying figures, wherein like reference characters indicate like parts throughout the several figures.

DETAILED DESCRIPTION OF THE PREFERRED EMBODIMENTS

Figure 1:
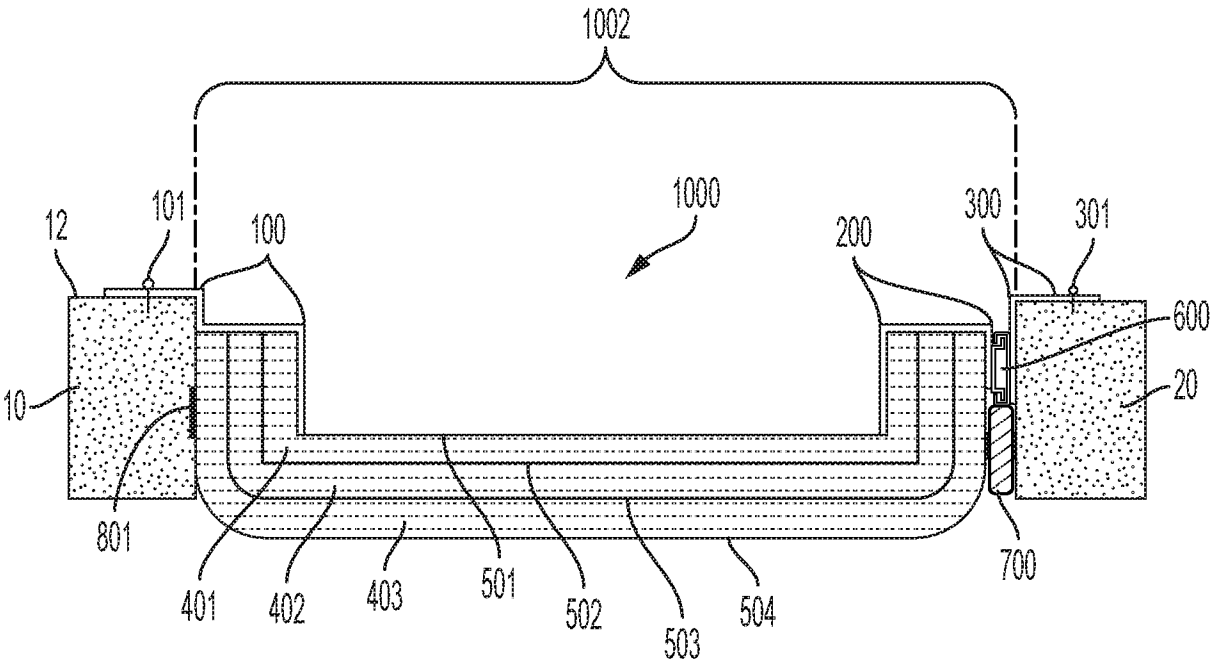
FIG. 1 is a cross-sectional view of the present disclosure.

The following description provides specific details, such as material types, compositions, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional techniques employed in the industry.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of exemplary embodiments, is not intended to limit the claims of this patent or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale, and certain features and certain views of the figures may be shown exaggerated in scale or in schematic in the interest of clarity and conciseness.

As used herein and throughout various portions (and headings) of this patent application, the terms "disclosure", "present disclosure" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference.

The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function.

Also, the terms "including" and "having" and "comprising" are used herein and in the appended claims in an open-ended fashion, and thus should be interpreted to mean "including, but not limited to . . . ."

Further, reference herein and in the appended claims to components and aspects in a singular tense does not necessarily limit the present disclosure or appended claims to only one such component or aspect, but should be interpreted generally to mean one or more, as may be suitable and desirable in each particular instance.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

All ranges disclosed herein are inclusive of the endpoints. A numerical range having a lower endpoint and an upper endpoint shall further encompass any number and any range falling within the lower endpoint and the upper endpoint. For example, every range of values (in the form "from a to b" or "from about a to about b" or "from about a to b," "from approximately a to b," "between about a and about b," and any similar expressions, where "a" and "b" represent numerical values of degree or measurement is to be understood to set forth every number and range encompassed within the broader range of values and inclusive of the endpoints.

The suffix "(s)" as used herein is intended to include both the singular and the plural of the term that it modifies, thereby including at least one of that term (e.g., the colorant (s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like.

All references are incorporated herein by reference.

Preferred embodiments of the present disclosure thus offer advantages over the prior art and are well adapted to carry out one or more of the objects of this disclosure. However, the present disclosure does not require each of the components and acts described above and is in no way limited to the above-described embodiments or methods of operation. Any one or more of the above components, features and processes may be employed in any suitable configuration without inclusion of other such components, features and processes. Moreover, the present disclosure includes additional features, capabilities, functions, methods, uses and applications that have not been specifically addressed herein but are, or will become, apparent from the description herein, the appended drawings and claims.

The present invention now will be described more fully hereinafter with reference to the accompanying drawings, in which some preferred embodiments of the invention are shown.

This invention may, however, be embodied in many different forms and should not be construed as limited to the embodiments set forth herein; rather, these embodiments are provided so that this disclosure will be thorough and complete, and will fully convey the scope of the invention to those skilled in the art. Like numerals refer to like embodiments throughout.

Referring to FIG. 1, a fire barrier assembly 1000 is installed in an expansion gap 1002 between first structural building member 10 and second structural building member 20. As used herein, gap 1002 is synonymous with the term expansion joint and either term may be used to mean the space 1002 between structural building members 10 and 20. As shown in FIG. 1, flange 100 is used to attach the left side of fire barrier assembly 1000 to building member 10. Flange 100 is preferably rigid metal and is attached to the top surface 12 of first structural building member 10 using fastener 101. Fastener 101 may be any fastener such as a bolt, screw, or nail. In some embodiments flange 100 is made of 20-gauge steel sheets that have been formed into a step-like configuration as shown in FIG. 1. Adhered to flange 100 is an assembly of fire blocking materials 401, 402 and 403. In some embodiments there are only two fire blocking materials. In other embodiments there are 3 or more. In at least one embodiment the fire blocking materials are ceramic blankets available commercially from suppliers such as Unifrax, Nutec and Thermal Ceramics, such as seen at https://www.unifrax.com/product-category/blankets/

Also shown in FIG. 1 are metallic foils 501 and 504 that cover the outside surfaces of fire blocking materials 401 and 403. In the embodiment shown in FIG. 1, there are also metallic foils 502 and 503 that sandwich fire blocking material 402 but interior metallic foils 502/503 are not necessary and, in some embodiments, can be left out to save costs. In at least one embodiment metallic foils 501-504 are about two mm thick and about two inches wide stainless-steel foil available commercially from US Foils, Inc. such as seen at www.usfoils.com.

An intumescent strip 801 is preferably placed between first structural building member 10 and fire barrier assembly 1000. Strip 801 may be attached to metallic foil 504. Foil 504 helps prevent fire from migrating between first structural building member 10 and fire barrier assembly 1000 since intumescent strip 801 will expand to fill any spaces between first structural building member 10 and fire barrier assembly 1000 in the event heat is sensed. Intumescent strip 801 is available commercially under the trade name Blaze Seal from RectorSeal of Houston, Tex. In at least one embodiment it is two mm thick and 2 inches wide.

The other side of assembly 1000 is attached to second structural building member 20 using shear track 600. Shear track 600 allows member 10 and member 20 to move in an axial direction along the longitudinal axis 2000 (see FIG. 3) relative to one another (i.e. moving out of the page as shown in FIG. 1) without damaging assembly 1000.

Figure 2B:
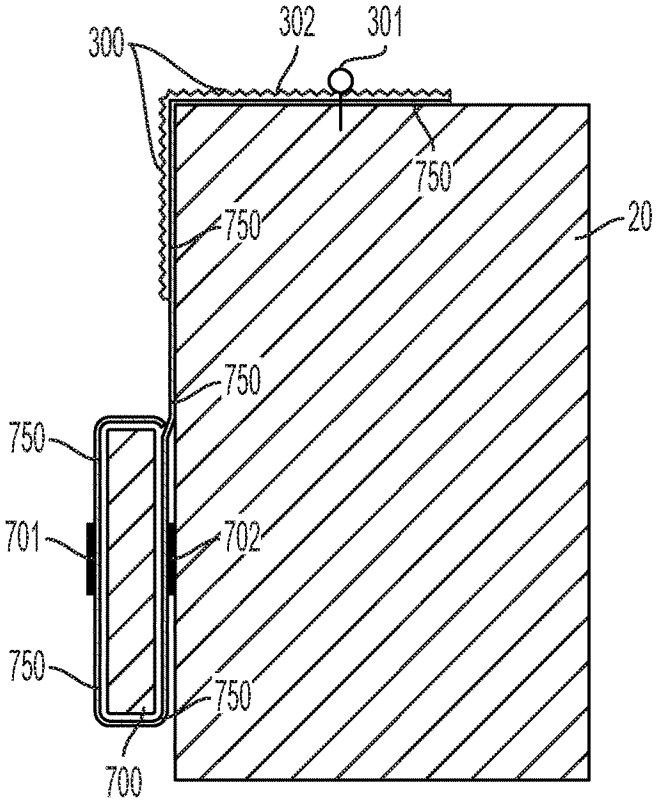
FIG. 2B is another detail view of the present disclosure from FIG. 1.
Figure 2A:
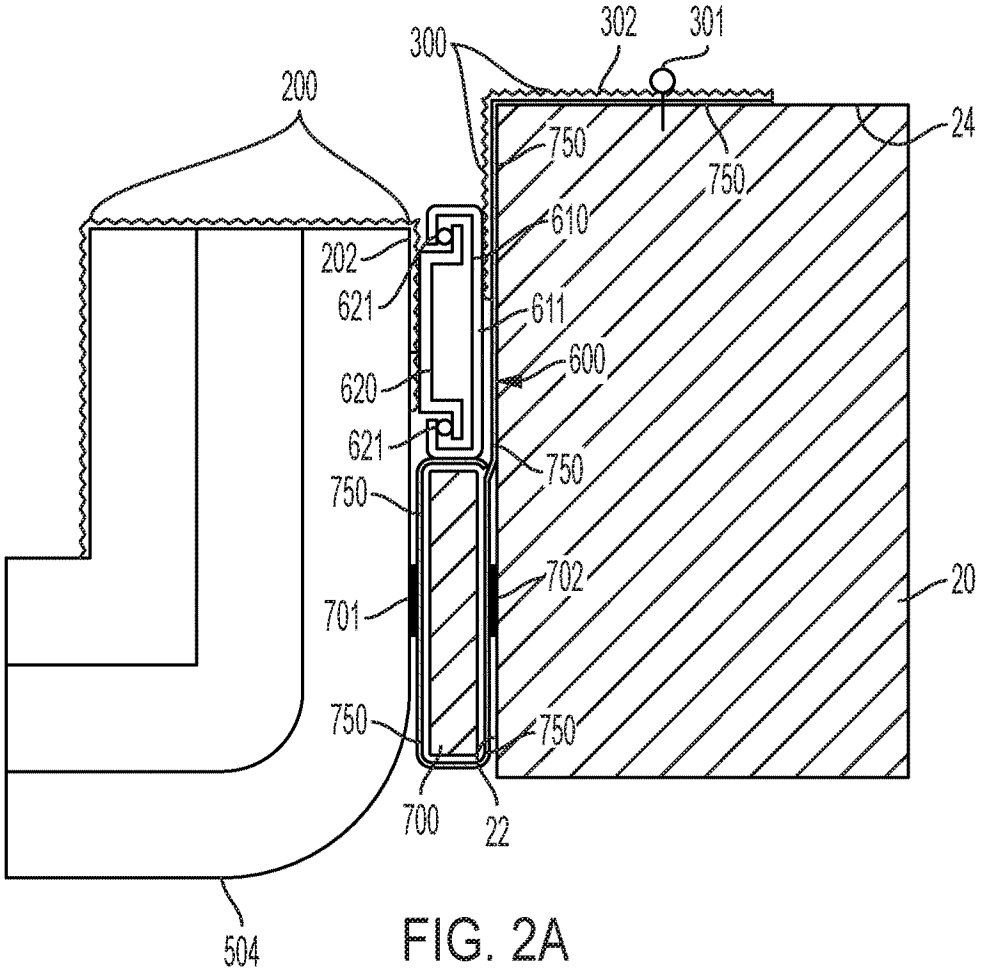
FIG. 2A is a detail view of the present disclosure from FIG. 1.

Referring now to FIGS. 1, 2A and 2B, below shear track 600 is infill blanket 700. Infill blanket 700 serves to fill the space below shear track 600 since track 600 protrudes outwardly from the inside surface 22 of member 20 and therefore assembly 1000 cannot be flush against structural building member 20 in the area below shear track 600.

Referring to FIG. 2A, shear track 600 comprises at least one female member 611 and one male member 620 so that male member 620 slides within female member 611. In this manner, structural building member 20 may move relative to structural building member 10 in the direction of axis 2000 as shown in FIG. 3. Male and female members 620/611 of track 600 may also include rollers 621 or other sliding mechanisms. In this manner, when relative movement between structural building members 10 and 20 occurs along axis 2000, male member 620 slides relative to female portion 611 so that track 600 prevents a shear load from damaging assembly 1000.

As shown in FIG. 2A, L-shaped flange 300 is attached to structural building member 20 by attaching the upper leg 302 of flange 300 to the top surface 24 of structural building member 20 using fastener. Previously, during manufacture of assembly 1000, female member 611 of shear track 600 was attached to flange 300 using fasteners 613 such as bolts, nails, adhesives and so forth. This configuration assures that female member 611 of shear track 600 may be attached to structural building member 20 avoiding the difficult, if not impossible task, of trying to attach female member 611 within the gap directly to structural building member 20.

Still referring to FIG. 2A, flange 200 was attached to male member 620 of shear track 600 during manufacture of assembly 1000. Flange 200 is roughly U-shaped and male member 620 is attached to leg 202 of flange 200 using fasteners 622 such as bolts, nails, adhesives and so forth. Both flange 200 and flange 300 are preferably made of rigid metal. In at least one embodiment these flanges are 20-gauge steel sheets formed into either the L-shaped or roughly U-shape of the respective flanges. Shear track 600 in at least one embodiment is a rigid metal such as aluminum.

Referring to FIGS. 2A and 2B, infill blanket 700 may be placed below track 600 with intumescent strips 701 and 702 on either side of blanket 700. Strips 701 and 702 help prevent fire from migrating between structural building member 20 and fire barrier assembly 1000 since these intumescent strips expand when exposed to heat to help fill any spaces between structural building member 20 and fire barrier assembly 1000 not protected by infill blanket 700. In at least one embodiment strips 701/702 are two mm thick and two inches wide. Intumescent strips 701 and 702 are available commercially under the trade name Blaze Seal from RectorSeal of Houston, Tex. In at least one embodiment infill blanket 700 is a ceramic blanket available commercially from suppliers such as Unifrax, Nutec and Thermal Ceramics.

Since the gap may be too narrow for an installer to attach blanket 700 with strips 701/702 inside the joint for the reasons discussed above, strap 750 is attached to, and supports, blanket 700 with strips 701/702 as shown in FIG. 2B. In at least one embodiment, strap 750 encircles blanket 700 and intumescent strips 701/702 are placed over strap 750. Blanket 700 and strips 701/702 may be attached to strap 750 by adhesive. Thus, strap 750 may first be positioned within gap 1002 before flange 300 supporting female member 611 or alternatively the entire right side of preassembled assembly 1000 including the entire track 600. In at least this embodiment semi-rigid strap 750 is about two mm thick and two inches wide and made of stainless-steel foil. Such a strap 750 is available commercially from US Foils, Inc.

Alternatively, during the manufacture of assembly 1000 blanket 700 and strips 701/702 may be attached to the outer surface of foil 504 by an adhesive without the need for strap 750.

At the job site, if strap 750 is used the installer may first attach strap 750 to the top surface 24 of member 20 and position blanket 700 with strips 701/702 in gap 1002 adjacent the inner edge 22 of member 20. Thus, the other end of strap 750 and infill blanket 700 will be positioned below track 600 when assembly 1000 is finally installed. The installer should confirm that strap 750 is fully positioned within gap or expansion joint 1002 to satisfy this condition. Then, the L-shaped flange 300 is positioned over strap 750 and then flange 300 is attached to member 20 using fastener 301. Fasteners 301 are positioned so that each fastener 301 also attaches strap 750 to member 20.

Figure 3B:
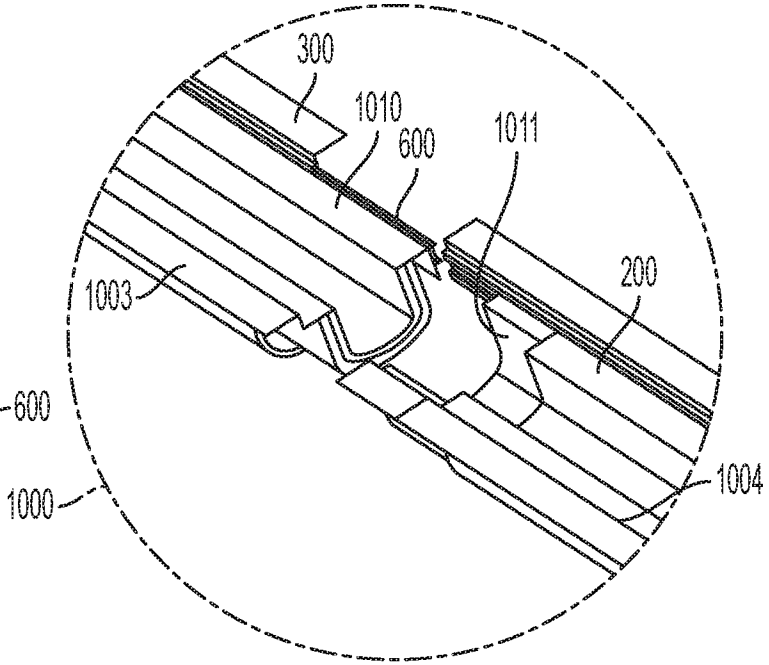
FIG. 3B is a detail view of the present disclosure from FIG. 3A.
Figure 3A:
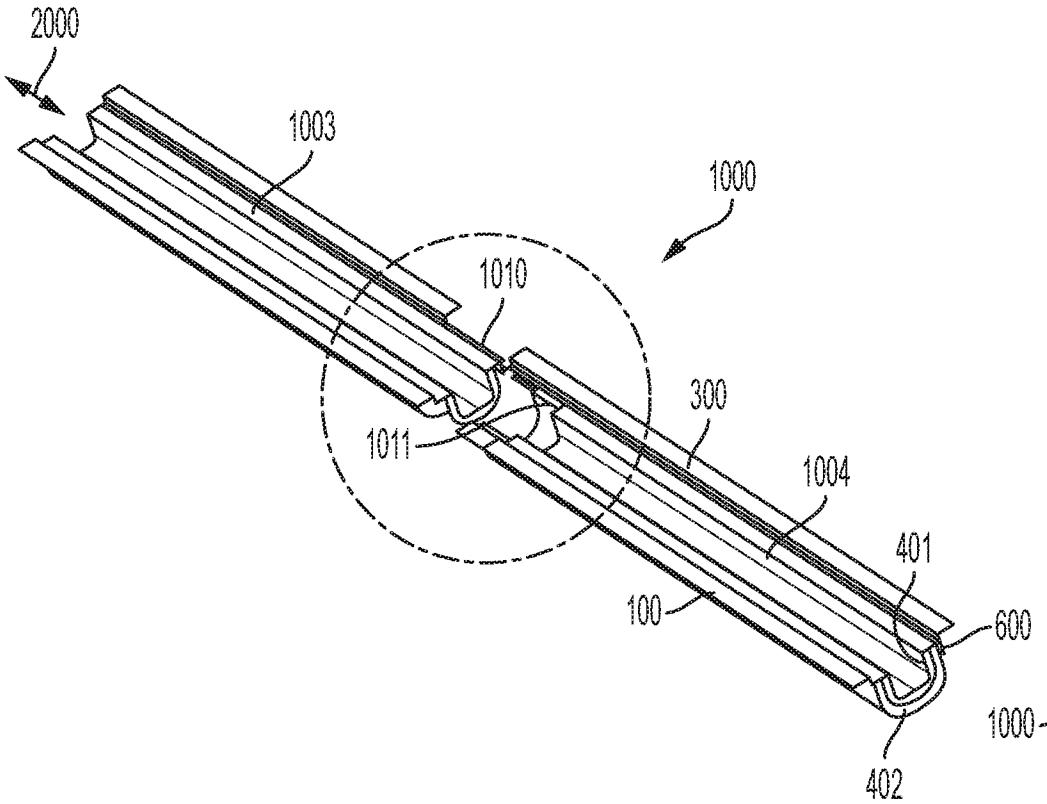
FIG. 3A is perspective view of the present disclosure.

Turning now to FIGS. 3A and 3B, preassembled sections 1001 and 1002 of assembly 1000 as shown in FIGS. 1, 2A, and 2B and discussed above, are illustrated. Each section 1003 and 1004 include a male end 1010 and a female end 1011. These ends between assemblies 1000 may be joined on site permitting the installer to assemble a fire blanket barrier of sufficient distance to fill the entire length of the gap or expansion joint. Once barriers are coupled there are no potential gaps or pathways in the coupled areas because of the male/female interdigitating. The male/female connecting ends can be installed in a one-step, drop-in process that makes installation much easier than stitching together ends that are not male/female configured. No cutting or stapling, or other attachments are required because of the overlapping of the male/female ends that require only a bead of fire-resistant caulk which may be applied over the seams once adjacent barriers are coupled.

Various configurations are possible. An assembly may be a mixture of one female end and one male end or in some configurations it may be desirable to have assemblies where both ends are either male of female (so long as corresponding assemblies with opposing ends are available for coupling in the field).

The following disclosure is illustrative of some of the embodiments of the present invention. Other embodiments within the scope of the claims herein will be apparent to one skilled in the art from consideration of the description set forth herein. It is intended that the specification, together with the examples, be considered exemplary only, with the scope and spirit of the invention being indicated by the claims which follow. Thus, all matter herein set forth or shown in the accompanying drawings should be interpreted as illustrative, and the scope of the disclosure and the appended claims should not be limited to the embodiments described and shown herein.

The methods that may be described above or claimed herein and any other methods which may fall within the scope of the appended claims can be performed in any desired suitable order and are not necessarily limited to any sequence described herein or as may be listed in the appended claims. Further, the methods of the present disclosure do not necessarily require use of the particular embodiments shown and described herein, but are equally applicable with any other suitable structure, form and configuration of components.

What is claimed is:

1. A first expansion joint fire barrier assembly to be installed in a gap between a first structural building member and a second structural building member comprising:

(a) a first layer of a fire-blocking material with a first end and a second end;

(b) a second layer of a fire-blocking material with a first end and a second end, the second layer of the fire-blocking material sandwiched adjacent to the first layer of fire-blocking material and wherein the ends of the first and second fire-blocking materials are offset so that said first expansion joint fire barrier assembly may be coupled onto an adjacent second expansion joint assembly having offset ends;

(c) a first flange for attaching the first expansion joint fire barrier assembly to the first structural building member wherein the first flange is attached to a top face of the first structural building member;

(d) a second flange for attaching the first expansion joint fire barrier assembly to the second structural building member wherein the second flange is attached to a top face of the second structural building member;

(e) an infill blanket and a support member attached to said infill blanket adapted to support said infill blanket proximate said second flange;

(f) a track having a male portion and a female portion configured so that said male portion moves relative to said female portion when said first structural building member moves longitudinally relative to said second structural member, and (g) at least one intumescent strip proximate the first flange and at least one intumescent strip proximate the second flange, and wherein said infill blanket support member supports said at least one intumescent strip proximate said second flange.

2. The expansion joint fire barrier assembly of claim 1 further comprising a foil member positioned between the first and second layers of fire-blocking material.

3. The expansion joint fire barrier assembly of claim 1 further comprising a foil member on the exterior surface of the second layer of fire-blocking material.

4. The expansion joint fire barrier assembly of claim 1 wherein the first and second layers of fire-blocking material are ceramic blankets.

5. The expansion joint fire barrier assembly of claim 1 wherein said support member comprises a semi-rigid member configured to be bent into an L-shape to contact said second structural building member and position said infill blanket and said at least one intumescent strip in the gap below said track.

6. An expansion joint fire barrier assembly to be installed in a gap between a first structural building member having a top surface and a second structural building member having a top surface, said assembly comprising:

(a) at least one fire-blocking material;

(b) a first flange for attaching the at least one fire-blocking material to the first structural building member;

(c) a second flange for attaching the at least one fire-blocking material to the second structural building member;

(d) an infill blanket and a support member attached to said infill blanket adapted to support said infill blanket;

(e) a track having a male portion and a female portion configured so that said male portion moves relative to said female portion when said first structural building member moves longitudinally relative to said second structural member, and (f) at least one intumescent strip proximate the first flange and at least one intumescent strip proximate the second flange, and wherein said infill blanket support member supports said at least one intumescent strip proximate said second flange.

7. The expansion joint fire barrier assembly of claim 6 wherein said female portion of said track being coupled to said second building member.

8. The expansion joint fire barrier assembly of claim 6 wherein said at least one fire-blocking material being a ceramic blanket.

9. The expansion joint fire barrier assembly of claim 6 wherein said support member positions said infill blanket and said at least one intumescent strip proximate said second flange in the gap below said track.

10. The expansion joint fire barrier assembly of claim 6, wherein the second flange being attached to a top face of the second structural building member.

11. A first expansion joint fire barrier assembly to be installed in a gap between a first structural building member and a second structural building member comprising:

(a) a first layer of a fire-blocking material with a first end and a second end;

(b) a second layer of a fire-blocking material with a first end and a second end, the second layer of the fire-blocking material sandwiched adjacent to the first layer of fire-blocking material and wherein the ends of the first and second fire-blocking materials are offset so that said first expansion joint fire barrier assembly may be coupled onto an adjacent second expansion joint assembly having offset ends;

(c) a first flange for attaching the first expansion joint fire barrier assembly to the first structural building member wherein the first flange is attached to a top face of the first structural building member;

(d) a second flange for attaching the first expansion joint fire barrier assembly to the second structural building member wherein the second flange is attached to a top face of the second structural building member;

(e) at least one intumescent strip proximate the first flange and at least one intumescent strip proximate the second flange;

(f) an infill blanket and a support member attached to said infill blanket adapted to support said infill blanket and said at least intumescent strip; and (g) a track having a male portion and a female portion configured so that said male portion moves relative to said female portion when said first structural building member moves longitudinally relative to said second structural member.

* * * * *